US012338035B2

(12) United States Patent
Buzzi et al.

(10) Patent No.: US 12,338,035 B2
(45) Date of Patent: Jun. 24, 2025

(54) CLOSURE FOR A SPOUT IN A THIN-WALLED PACKAGE

(71) Applicant: GUALA PACK S.P.A., Castellazzo Bormida (IT)

(72) Inventors: Alberto Buzzi, Castellazzo Bormida (IT); Riccardo Zammori, Castellazzo Bormida (IT)

(73) Assignee: Guala Pack S.P.A., Castellazzo Bormida (IT)

( * ) Notice: Subject to any disclaimer, the term of this patent is extended or adjusted under 35 U.S.C. 154(b) by 0 days.

(21) Appl. No.: 18/247,185

(22) PCT Filed: Oct. 7, 2021

(86) PCT No.: PCT/IB2021/059195
§ 371 (c)(1),
(2) Date: Mar. 29, 2023

(87) PCT Pub. No.: WO2022/136945
PCT Pub. Date: Jun. 30, 2022

(65) Prior Publication Data

US 2023/0373689 A1 Nov. 23, 2023

(30) Foreign Application Priority Data

Dec. 23, 2020 (IT) ..... 102020000032075

(51) Int. Cl.
*B65D 41/34* (2006.01)
*B65D 55/16* (2006.01)
*B65D 75/58* (2006.01)

(52) U.S. Cl.
CPC ..... *B65D 41/3428* (2013.01); *B65D 55/16* (2013.01); *B65D 75/5883* (2013.01)

(58) Field of Classification Search
CPC B65D 41/3428; B65D 55/16; B65D 75/5883; B65D 41/3452; B65D 41/3414
See application file for complete search history.

(56) References Cited

U.S. PATENT DOCUMENTS 4,501,373 A * 2/1985 Heinlein ..... B65D 41/3452 215/253
4,715,506 A * 12/1987 McLaren ..... B65D 41/3452 215/252

(Continued)

FOREIGN PATENT DOCUMENTS

DE 102019002719 A1 10/2020
IT 201900007497 A1 11/2020

OTHER PUBLICATIONS

International Search Report for International Patent Application No. PCT/IB2021/059195, mailed Jan. 5, 2022.

(Continued)

*Primary Examiner* — James N Smalley
(74) *Attorney, Agent, or Firm* — Armstrong Teasdale LLP

(57) ABSTRACT

A closure for a spout of a thin-walled flexible package has a cap and a tamper evident seal having a tamper evident ring suitable for being applied to the spout, a tamper evident portion integral with the cap, and at least one breakable bridge which, when the tamper evident seal is unbroken, joins the tamper evident ring to the tamper evident portion. The tamper evident ring has an upper face that delimits the tamper evident ring at the top, the upper face consisting of a wavy surface having circumferentially successive ridges and valleys, each valley having a bottom surface. The tamper evident portion has at least one tamper evident tooth having a top face that is contained in a respective valley. The at least one breakable bridge joins the bottom surface and the top face and is contained in the valley.

10 Claims, 3 Drawing Sheets

(56) References Cited

U.S. PATENT DOCUMENTS

| | | | | |
|---|---|---|---|---|
| 4,828,127 | A * | 5/1989 | Young | B65D 41/3414 215/252 |
| 5,402,901 | A * | 4/1995 | Carvalheiro | B29C 45/44 215/252 |
| 5,484,071 | A * | 1/1996 | Zumbuhl | B65D 41/3447 215/256 |
| 6,305,579 | B1 * | 10/2001 | Long, Jr. | B65D 41/47 222/525 |
| 6,938,787 | B2 * | 9/2005 | Shinozaki | B65D 41/3452 222/153.02 |
| 2004/0200797 | A1 * | 10/2004 | Hicks | B65D 41/0421 220/288 |
| 2019/0144189 | A1 | 5/2019 | Van Der Molen | |
| 2022/0119163 | A1 | 4/2022 | Wommelsdorf et al. | |
| 2022/0250816 | A1 | 8/2022 | Tamarindo | |

OTHER PUBLICATIONS

Italian Search Report for Italian Patent Application No. 2020000032075, mailed Sep. 6, 2021, The Hague, NL.

* cited by examiner

CLOSURE FOR A SPOUT IN A THIN-WALLED PACKAGE

CROSS-REFERENCE TO RELATED APPLICATION

This application is a National Stage Application of International Patent Application No. PCT/IB2021/059195, having an International Filing Date of Oct. 7, 2021, which claims priority to Italian Application No. 102020000032075, filed Dec. 23, 2020, the entire contents of which are hereby incorporated by reference herein.

FIELD OF THE INVENTION

This invention is in the field of thin-walled flexible packaging, customarily referred to as "pouches," and particularly in the field of pouches fitted with a spout for dispensing the product, customarily referred to as "spouted pouches."

BACKGROUND OF THE INVENTION

These packages are now widely used and appreciated for their great convenience of use and versatility, especially among children, for whom the use of the spout also has a playful component. Currently, they are mainly used for containing products such as juices and fruit purees, yoghurt, energy drinks, and the like. Currently, several hundred million pieces are sold annually.

One of the needs of the industry is to ensure comfortable use of the flexible packaging, especially when users hold the spout between their lips.

At the same time, the closures must have a tamper evident seal that makes it clear to the user if the package has already been opened, especially in the case of food products, for which correct preservation is essential, without, of course, compromising the convenience of use.

Moreover, given the numbers involved, the correct disposal of the packaging and the closure of the spout after use is one of the most important requirements in the sector; in this regard, many companies are concentrating their research and development efforts on defining closures for which, after unscrewing the cap from the spout, the cap remains attached to said spout, so that it cannot be dispersed into the environment.

SUMMARY OF THE INVENTION

It is the object of this invention to provide a closure for a spout of a thin-walled flexible packaging that satisfies the requirements of the sector, and in particular that is comfortable and convenient for the user to use.

This object is achieved by a closure as described and claimed herein. Advantageous embodiments of the present invention are also described.

BRIEF DESCRIPTION OF THE FIGURES

The features and advantages of the closure according to this invention will become apparent from the following description, given by way of non-limiting example according to the figures in the accompanying drawings, wherein.

DETAILED DESCRIPTION

Figure 1B:
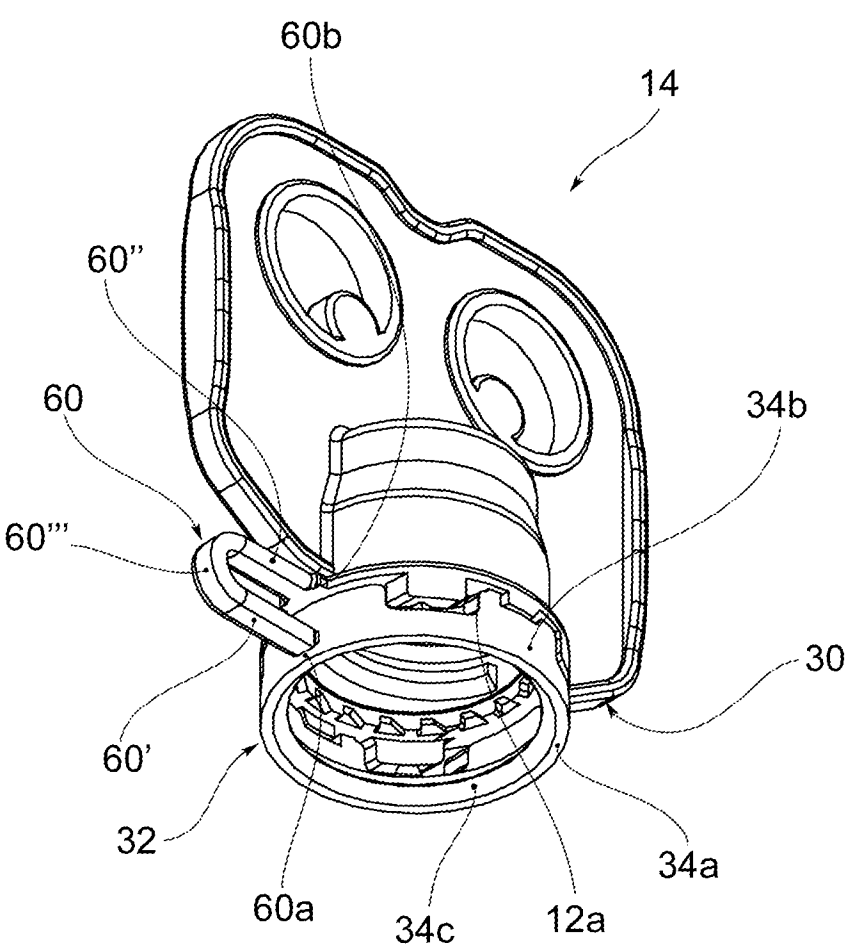
FIGS. 1*a* and 1*b* show a closure according to one embodiment of the invention.
Figure 1A:
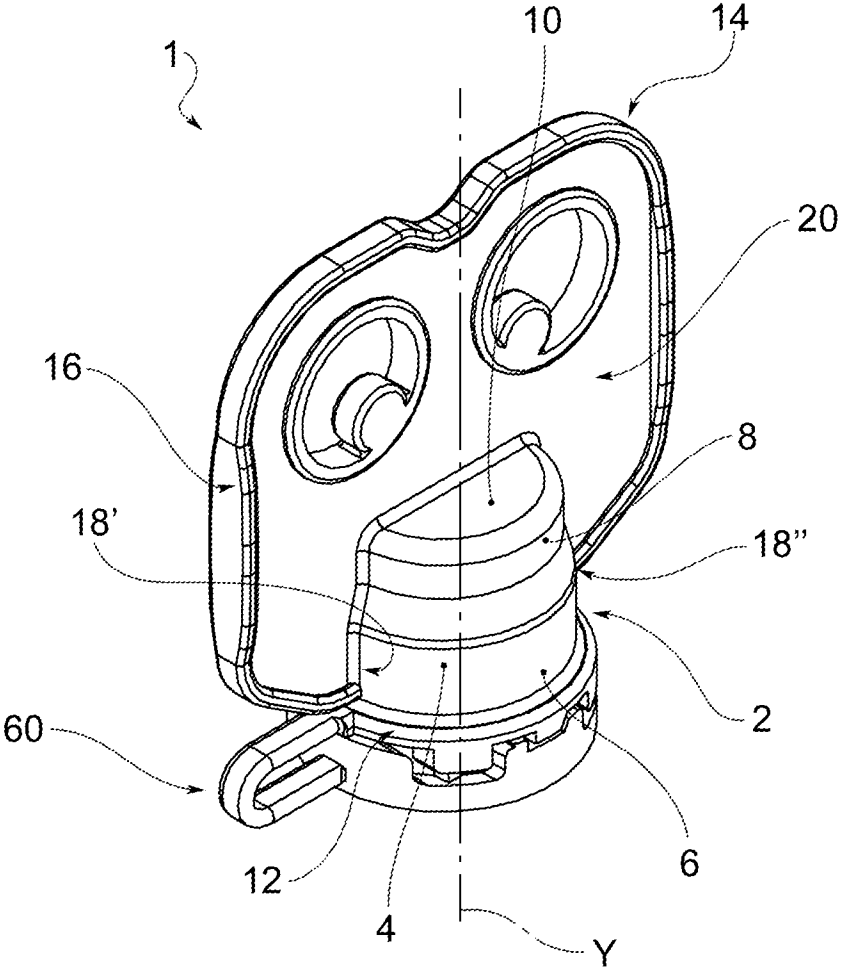
Figure 2:
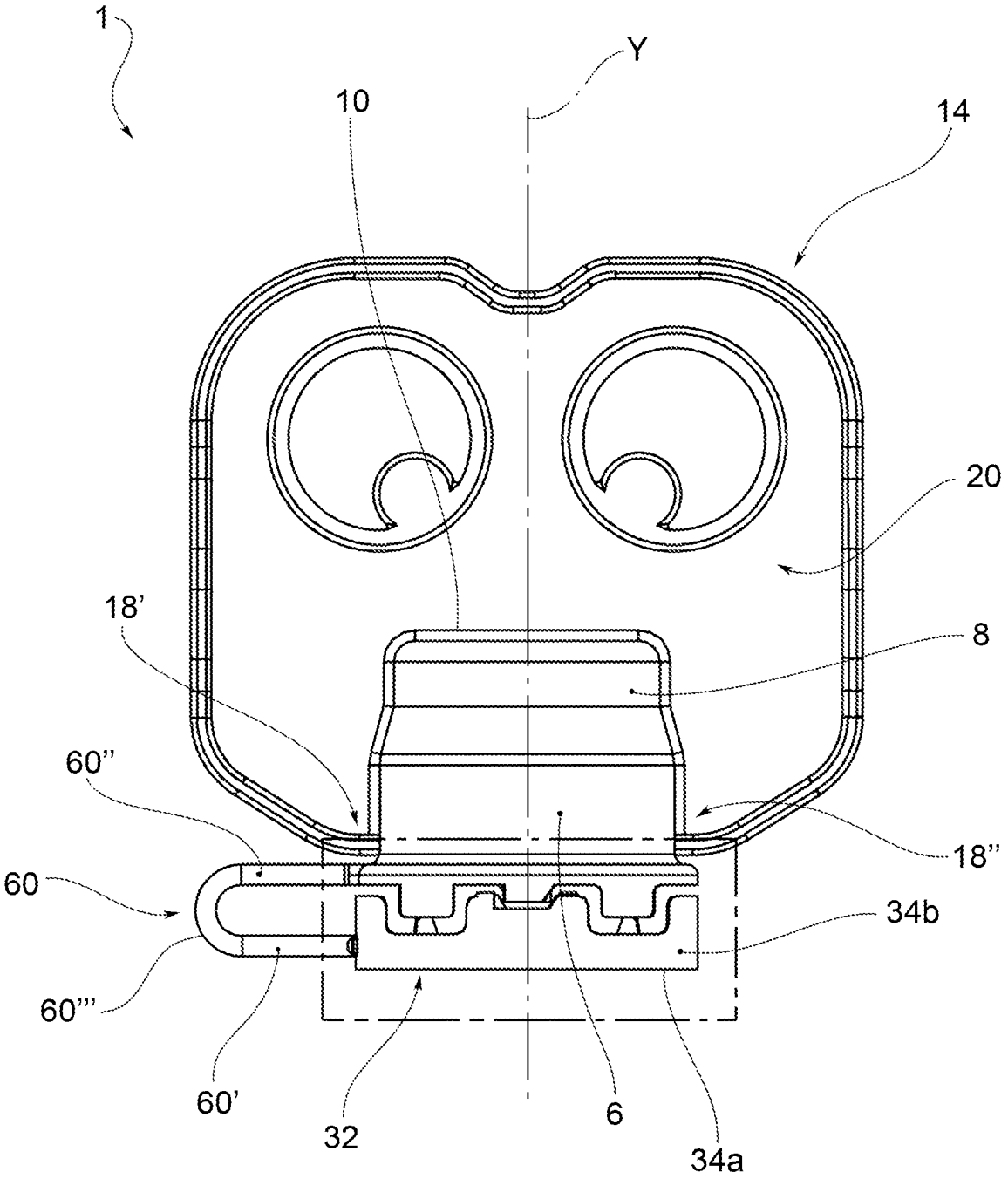
FIG. 2 is a front view of the closure of FIGS. 1*a* and 1*b;*
Figure 3A:
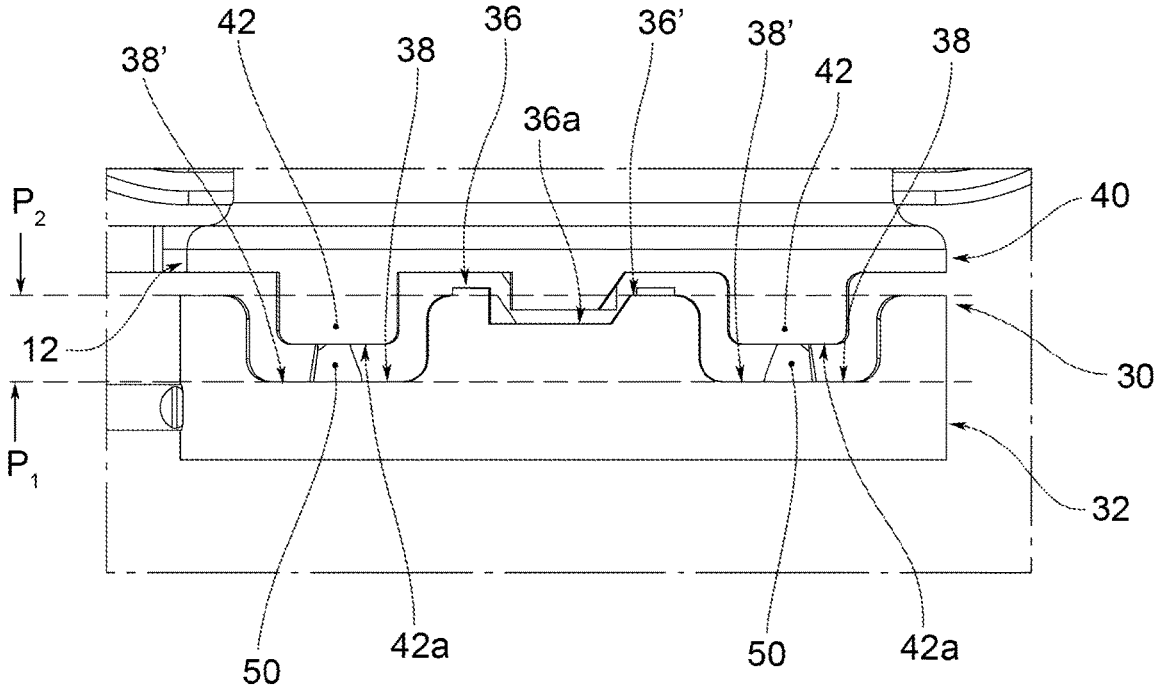
FIG. 3*a* shows a tamper evident seal of the closure, according to one embodiment of the invention, in a configuration with the seal intact and unbroken.
Figure 3B:
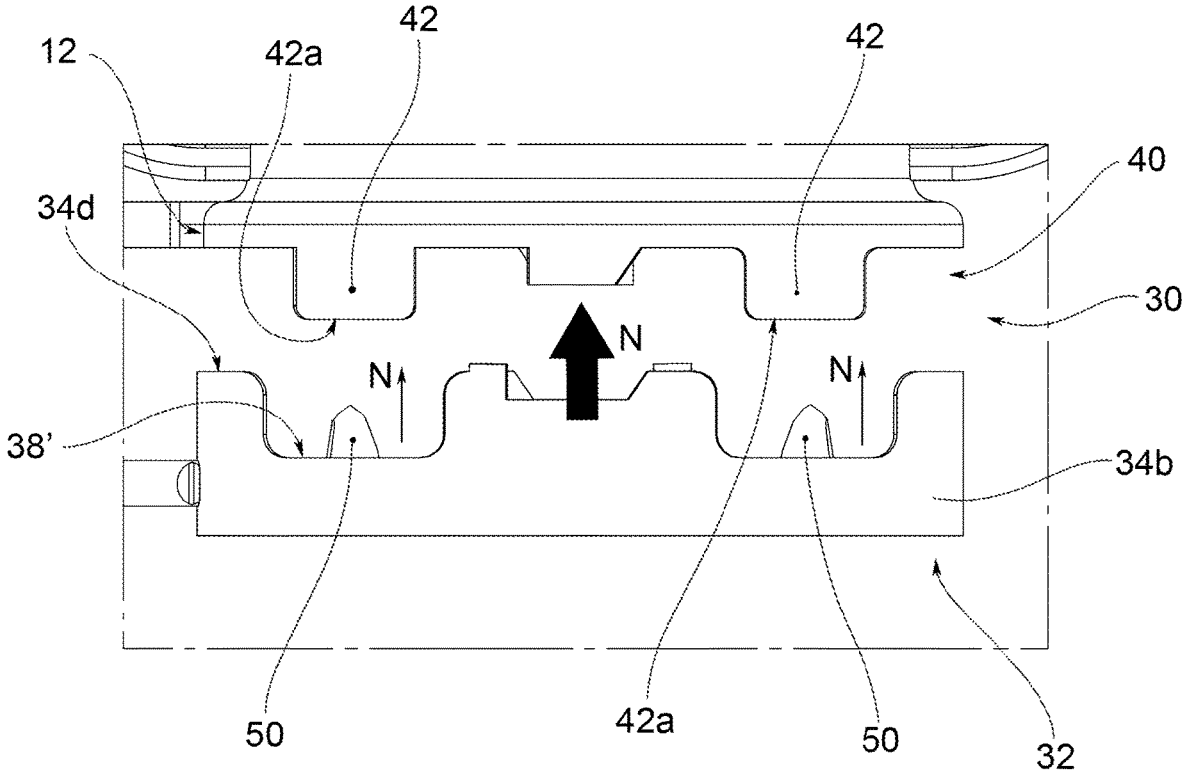
FIG. 3*b* shows the tamper evident seal, in a configuration with the seal broken.

In reference to the figures in the attached drawings, the numeral 1 has been used to indicate as a whole a closure for a thin-walled package, usually referred to as a "pouch."

The closure 1 comprises a cap 2 screwable to the spout, the cap comprising an annular cap wall 4 having a central cap axis Y, extending between a lower end 6 and an upper end 8, enclosed by a cap base 10.

For example, the cap wall 4 is cylindrical or tapered from the lower end 6 toward the upper end 8, e.g., substantially frustoconical.

Preferably, the cap 2 comprises a cap flange 12, at the lower end 6, projecting radially toward the outside from the cap wall 4.

Preferably, the closure 1 comprises a grip surface 14 for gripping the closure, integral with the cap 2.

For example, the grip surface 14 is substantially flat and an imaginary median plane of the grip surface 14 is defined, passing through the cap axis Y.

For example, the grip surface 14 comprising a bead 16 extends from a first zone 18' of the outer surface of the cap wall 4 to a second zone 18" of the cap wall 4, diametrically opposed to the first zone 18'.

According to this example, the grip surface 14 further comprises a partition 20, contained between two flat, parallel faces, extending between the bead 16, the cap wall 4, and the cap base 10. Preferably, the partition 20 is lower with respect to the bead 16.

The closure 1 further comprises a tamper evident seal 30 suitable for indicating the first opening of the closure.

The tamper evident seal 30 comprises a tamper evident ring 32 suitable for being attached to the spout, whereby it is connected thereto at least axially, and, for example, free to rotate thereon.

The tamper evident ring 32 comprises an annular wall 34 having a lower face 34*a*, e.g., in the form of a circular crown lying in an imaginary plane orthogonal to the cap axis Y, a cylindrical outer side surface 34*b*, an inner side surface 34*c*, and an upper annular face 34*d*, which delimits the annular wall 34 at the top.

A normal vector to the upper face 34*d* at a point P on said upper face being defined as a vector perpendicular to the plane tangent to the upper face at point P, the normal vectors N to the upper face 34*d* are parallel to the cap axis Y.

The upper face 34*d* is a wavy surface formed by a 25 circumferential succession of ridges 36 and valleys or depressions 38; for example, each valley 38 has bottom surface 38', for example a flat bottom surface, and each ridge 36 has a ridge surface 36', on which a ridge indent 36*a* opens. Preferably, the wavy surface has a substantially square 5 wave pattern with rounded edges.

For the upper face 34*d*, with reference to at least one of said valleys 38, a lower plane P1 is defined, which is tangent inferiorly to the bottom surface 38', and, with reference to at least one of said ridges 36, an upper plane P2 is defined, which is tangent superiorly to the ridge surface 36'. Preferably, the upper face 34*d* is contained between the lower plane P1 and the upper plane P2.

The tamper evident seal 30 further comprises a tamper evident annular portion 40, coaxial to the cap 2, integral therewith and preferably made in one piece with said cap 2.

The tamper evident portion 40 comprises at least one tamper evident tooth 42 projecting axially, for example, from the cap flange 12.

Said at least one tamper evident tooth 42 is configured whereby, when the tamper evident seal 30 is unbroken, it is at least partially received in a respective valley 38 of the upper face 34*d* of the tamper evident ring 32. In other words, said at least one tamper evident tooth 42, when the tamper evident seal 30 is unbroken, extends beyond the upper plane P2, toward the lower plane P1. In still other words, the tamper evident portion 40 and the tamper evident ring 32 interpenetrate axially, whereby the tamper evident teeth 42 are received in the respective valleys 38.

The tamper evident seal 30 further comprises at least one breakable bridge 50, which connects the tamper evident ring 32 to the cap 2.

On the side of the tamper evident ring 32, said at least one bridge 50 protrudes from the respective bottom surface 38' of the upper face 34*d* and is entirely received in the respective valley 38; in other words, it extends between the lower plane P1 and the upper plane P2.

On the side of the cap 2, i.e., the tamper evident portion 40, said at least one bridge 50 is joined to the respective tamper evident tooth 42, and in particular to a top face 42*a* of said tamper evident tooth 42, facing the bottom surface 38' from which said tamper evident tooth 42 protrudes.

Preferably, said at least one bridge 50 is axially tapered, being thicker near the attachment to the bottom surface 38' of the tamper evident ring 32 and thinner near the top face 42*a* of the tamper evident portion 40 of the cap 2.

Advantageously, the configuration of the tamper evident seal ensures a high level of comfort in the use of the flexible packaging because, when the bridges break as a result of unscrewing the cap, the residual sections that remain connected to the tamper evident ring are entirely contained in the valleys of the tamper evident ring and therefore cannot get in the way of or bother users who use the spout by holding it between their lips.

Preferably, moreover, the closure comprises a strap 60 suitable for keeping the cap 2 connected to the tamper evident ring 32 even when the tamper evident seal is broken. In other words, whereas the bridges break when the cap is first unscrewed from the spout, the strap is permanently connected, unless it is torn off forcibly by pulling.

The strap 60 extends from a region 60*a* of the outer side surface 34*b* of the tamper evident ring 32 to a region 60*b* of the outer side surface of the cap 2; for example, at the cap flange 12. In particular, the strap 60 comprises a first section 60' projecting from the tamper evident ring 32, which is preferably straight, a second segment 60" projecting from the cap 2, which is preferably straight, and an arched connecting segment 60''' connecting the first segment 60' and the second segment 60".

For the strap 60, a median imaginary plane is defined with respect to the thickness, on which the cap axis Y lies; preferably, the median imaginary plane of the strap 60 coincides with the median imaginary plane of the grip surface 14.

The closure is preferably made in a single piece of plastics material, for example by injection molding.

Innovatively, the closure according to this invention satisfies the aforementioned requirements, in that it provides a tamper evident seal that does not interfere with a comfortable use of the spout.

It is clear that a person skilled in the art, in order to satisfy current needs, could make modifications to the closure described above, said modifications all being contained within the scope of protection as defined in the following claims.

What is claimed is:

1. A closure for a spout of a flexible thin-walled packaging, comprising:

a cap comprising an annular cap wall having a central cap axis; and a tamper evident seal comprising a tamper evident ring suitable for being applied to the spout, a tamper evident portion integral with the cap, and a plurality of breakable bridges that, when the tamper evident seal is unbroken, join the tamper evident ring to the tamper evident portion;

wherein the tamper evident ring comprises an upper face that delimits the tamper evident ring at the top, the upper face consisting of a wavy surface comprising ridges and depressions which follow each other circumferentially, wherein each depression has a bottom surface;

wherein the tamper evident portion comprises a plurality of tamper evident teeth, each tamper evident tooth having a respective top face; and wherein each said top face is contained in a respective depression having a respective bottom surface; and wherein each said breakable bridge joins the respective bottom surface and the respective top face and remains contained in said depression when the tamper evident seal is broken.

2. The closure of claim 1, wherein, upon defining a normal vector to the upper face at a point on said upper face as a vector perpendicular to a plane tangent to the upper face at the point, said normal vector to the upper face is parallel to the central cap axis.

3. The closure of claim 1, wherein said wavy surface has a substantially square wave pattern.

4. The closure of claim 1, wherein each said bottom surface is flat.

5. The closure of claim 1, wherein each tamper evident tooth is axially tapered, having a larger resistant section close to the respective bottom surface and a smaller resistant section close to the respective top face.

6. The closure of claim 1, further comprising a strap suitable for keeping the cap connected to the tamper evident ring even when the tamper evident seal is broken.

7. The closure of claim 6, wherein the strap extends from a region of an outer side surface of the tamper evident ring to a region of an outer side surface of the annular cap wall.

8. The closure of claim 1, further comprising a grip surface that is integral with the cap.

9. The closure of claim 8, wherein the grip surface is substantially flat.

10. The closure of claim 9, further comprising a strap suitable for keeping the cap connected to the tamper evident ring even when the tamper evident seal is broken, wherein the strap extends from a region of an outer side surface of the tamper evident ring to a region of an outer side surface of the annular cap wall, wherein a median imaginary plane is defined for the strap, on which the central cap axis lies, a median imaginary plane is defined for the grip surface, on which the central cap axis lies, and wherein the median imaginary plane of the strap coincides with the median imaginary plane of the grip surface.

* * * * *